United States Patent [19]

Guay, Jr.

[11] Patent Number: 4,522,605

[45] Date of Patent: Jun. 11, 1985

[54] GRAVITY-OPERATED TOY

[76] Inventor: Lawrence A. Guay, Jr., 29 Walter St., Portland, ME. 04103

[21] Appl. No.: 519,024

[22] Filed: Aug. 1, 1983

[51] Int. Cl.[3] ..... A63H 21/02

[52] U.S. Cl. ..... 446/228

[58] Field of Search ..... 446/228, 273, 230, 30, 446/7, 229, 231, 232; 273/351, 369

[56] References Cited

U.S. PATENT DOCUMENTS

| | | | |
|---|---|---|---|
| 1,178,158 | 4/1916 | Hitchings | 273/351 |
| 1,615,986 | 2/1927 | Knight | 446/230 |
| 2,388,513 | 11/1945 | Zwickel | 446/228 |
| 3,600,843 | 8/1971 | Becker | 446/228 |
| 3,793,764 | 2/1974 | Gagnon, Sr. | 446/228 |

*Primary Examiner*—Mickey Yu

*Attorney, Agent, or Firm*—Abbot Spear; Laforest S. Saulsbury

[57] ABSTRACT

A gravity-operated toy operable over an inclined guide line extending between two fixed supports in which the toy-like object is detachably and adjustably connected to the guide line by forward and rear adjustable sleeves and eye connectors separable to be detached for removal of the toy from the guide line and adjustable to level the toy on the line to its best advantage. The control line is connected to the rear connector and runs over a fixed support eye to a freely held reel with two dowel handle extensions that require skill for the manipulation of the toy and its connecters upon the guide line as by release for downward descent and rewinding for the ascent of the toy upon the guide wire.

1 Claim, 5 Drawing Figures

4
15
14
21
10
17
16
16
17
19
4
11
15
14
12
2
18
2
13
20

17
17
10
16B
16
18
19
16C
16A
13

17
10
16
16B
16C
16A
13

10
15
14
19
21
11

20
19
20A

20B

GRAVITY-OPERATED TOY

BACKGROUND REFERENCES

U.S. Pat. No. 518,931
U.S. Pat. No. 3,838,855

BACKGROUND OF THE INVENTION

Toys that have objects that travel along inclined paths under the influence of gravity are of interest to children. One type of such a toy has its path established by a guide wire supported in an inclined manner and with an object slidably connected thereto.

Such toys require that the object be manually engaged during the return of the objects to their elevated starting positions and do not provide any control of their downward travel.

THE PRESENT INVENTION

The general objective of the present invention is to provide apparatus of the above referred-to types which not only enable the objects to be returned to their starting positions from a remote location but also enable their downward travel to be controlled if it is desired to modify their descent.

In accordance with the invention their objective is attained by providing the supporting structure to which the higher end of the guide line is attached with a guide close to but below that end. The guide carries a control line from a hand held reel which line is connected to the object. The reel is of a type from which line can be pulled by the object when free to travel under the influence of gravity and which not only enables the line to be quickly reeled in to pull the object back to its starting position but also enables the rate of descent to be controlled as desired.

A particular object of the invention is to provide an inexpensive reel capable of meeting the above indicated uses when operated by a child, an objective attained with the reel formed with an open spool of a substantial diameter mounted on a dowel the ends of which are to be held and turned by the thumb and forefinger of the child's hands with the large diameter of the reel enabling substantial length of line to be reeled in on each revolution to offset the fact that the rate at which the reel can be turned is relatively slow.

Other objectives of the invention and the manner in which they are attained will be apparent from the following description of a preferred embodiment of the invention and the appended claims.

PRIOR ART STATEMENT

The previously cited United States patents represent the only toys known to me relevant to the present invention.

Of these, U.S. Pat. No. 518,931 provides a toy in which the inclination of the guide wires can be reversed while U.S. Pat. No. 2,388,513 teaches the use of a line connected to a toy air plane on a line 18 to effect the release of toy bombs. U.S. Pat. No. 3,838,855 disclosed a toy air plane carried by a support line connected to a fixed reel.

BRIEF DESCRIPTION OF THE DRAWINGS

The accompanying drawings illustrate a preferred embodiment of the invention which is a toy and of which—

THE PREFERRED EMBODIMENT OF THE INVENTION

Figure 1:
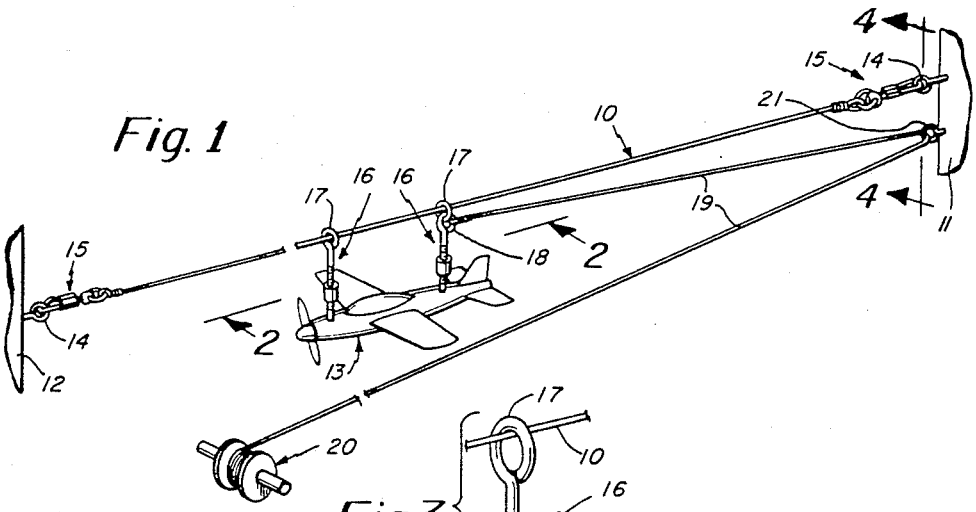
FIG. 1 is a somewhat schematic view of a toy in accordance with the invention set up for use.
Figure 2:
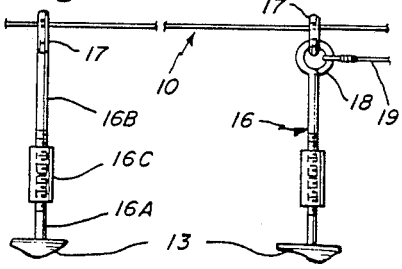
FIG. 2 is a view thereof, on an increase in scale, taken substantially along the indicated line 2—2 of FIG. 1.
Figure 3:
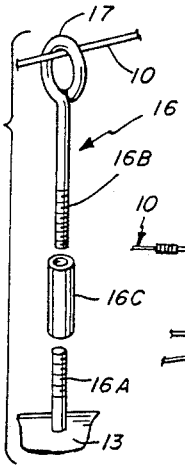
FIG. 3 is an exploded view, on a further increase in scale, of the forward connection of the toy concept with the guide line.
Figure 4:
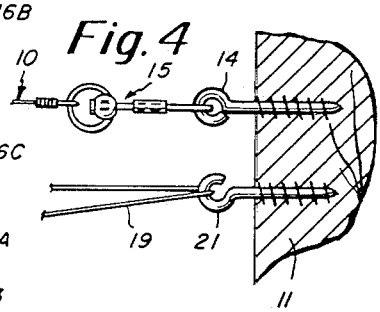
FIG. 4 is a section taken approximately along the indicated line 4—4 of FIG. 1.
Figure 5:
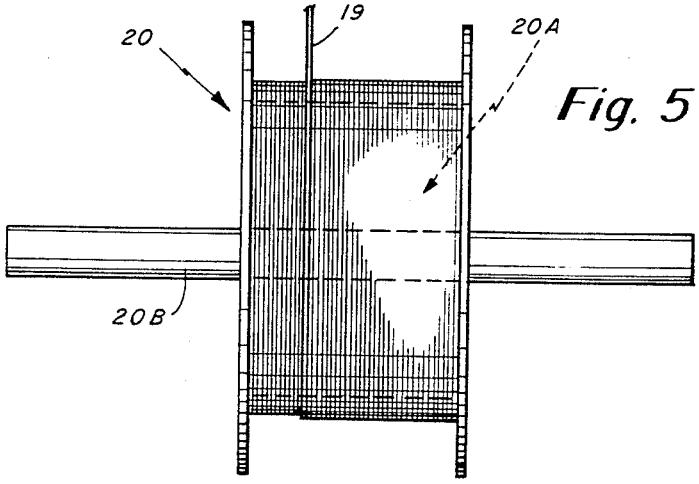
FIG. 5 is a view, on an increase in scale, of the reel.

The toy illustrated by the drawings has a guide line 10 shown as attached at one end to a first support 11 and at its other end to a second support 12 with the positions of attachment such that the guide line 10 is so downwardly inclined that any object representing a flying object, in the disclosed embodiment, a toy airplane generally indicated at 13, slidably supported thereby will slide rapidly under the influence of gravity along the guide line 10 unless restrained.

The first and second supports may be portable or fixed structure or objects whether the toy is to be installed indoors or outdoors. While the distance between the supports depends not only on what is conveniently available for use for that purpose but also on the age of the child playing with the toy. The supports 11 and 12 are shown as provided with screw eyes 14 each at an appropriate different level to establish the wanted incline of the guide line 10. The guide line 10 has swivel snaps 15 at its ends enabling it to be quickly and easily connected to or detached from the screw eyes 14.

The toy airplane 13 is attached to the guide line 10 by forward and rearward connectors, generally indicated at 16 with each including a closed eye or loop 17 through which the guide line 10 extends. In practice and in order that the airplane 13 can be detached from the guide line and replaced by another object, the connectors 16 are detachable with each shown as consisting of a first threaded section 16A anchored in the airplane 13, a second oppositely threaded section 16B which includes the eye piece 17, and a sleeve 16C appropriately threaded to enable the turning thereon in one direction to couple the sections 16A and 16B and in the other direction to release the section 16A.

The section 16B of the rearward connection 16 has a second closed eye or loop 18 directly below the eye piece 17 to which is connected the control line 19 from a reel, generally indicated at 20. The screw eye 14 of the support 11 establishes the high end of the guide line 10 and below that screw eye but close thereto, is a screw eye 21 the eyelet of which opens upwardly to establish a guide for the line 19 to which the line may be securely connected without the necessity of a threading operation.

The reel 20 on which the line 19 is wound consists of an open spool 20A of a diameter desirably in the three to four inch range and with end walls of an appropriately larger diameter, say six inches by way of example and not of limitation, to ensure that in reeling in the line, it cannot escape over the reel end walls. The spool 20A is shown as fixed on the central portion of a dowel 20B.

In use, each end of the dowel 20B is held between the thumb and forefinger of the appropriate hand enabling the reel to be easily turned in the winding direction with the diameter of its spool resulting in a substantial length of line being rewound on each revolution and with the relatively larger spool end walls making it easy for a child to rewind the control line 19 and rapidly pull the airplane 13 upwardly to a wanted starting position. When the airplane 13 is to be released, the thumb and forefinger of each hand are employed as yokes rotatably supporting the ends of the dowel 20B enabling the reel 20 to turn freely in response to the pull of the airplane sliding down the guide line 10 with the thumb and fore-fingers easily used to apply braking pressure on the dowel 20B to control the downward travel of the airplane in a wanted manner.

While the guide line 10 is shown in FIG. 1 as taut, that is, of course, not a requirement but usually it is desirable that the guide line be as taut as practicable. As long as the sag is not such as to interfere with substantial travel of the airplane or other object from the high end of the guide line 10 towards the lower end, it not only can be tolerated but also often used to advantage. The sag exists relatively near the lower end of the guide line and in the case of the airplane 13, for example, its dive tends to level off and any flat surfaced object in the appropriate position can serve as a landing field.

For use indoors, it is usually possible to use a guide line eighteen feet in length and for both indoor and outdoor uses, satisfactory operation is ensured with the guide line inclined about 15°. The weight of many objects that can be used is in the neighborhood of six ounces.

In practice, the guide line 10 is preferably monofilament of a suitable weight test, forty pounds test, in practice. The control line 19 is preferably nylon, in practice white bobbin nylon.

It will be apparent from the foregoing, the general manner in which toys in accordance with the invention are used. One of its general purposes is to keep the toy as simple as possible both to keep its cost down and to provide an adaptable basic toy the uses of which may be varied as different objects are used.

I claim:

1. A gravity-operated toy comprising spaced first and second guide line supports having respectively fastener elements, the fastener on the first support being higher than the fastener upon the second support, a guide line respectively having fasteners on the respective opposite ends thereof and respectively engageable with the respective support fastener elements whereby the guide line will be supported in an inclined manner, a toy-like object and means for slidably connecting the same to the inclined guide line to slide rapidly downwardly thereover when unrestrained, said toy-like object connecting means including longitudinally-spaced forward and rear connectors each having a closed eye piece with a threaded shank for traversing the guide line, a threaded stud anchored in the toy-like object with its threads exposed and an oppositely internally threaded sleeve for detachably and adjustably securing the threaded anchored stud and toy-like object to the eye piece shank whereby the toy-like object can be detached for replacement by another object and adjusted to level the object with respect to the line for best operation thereupon, a control line guide connected to the first support just below the toy-like object guide line support and a freely holdable reel assembly, a control line slidable over said control line guide support and connected at one end to the toy-like object and at the other end connected to and wound in quantity upon said freely holdable reel, said reel having end walls of large diameter beyond the wound line on the reel so that the control line cannot readily escape thereover and axially-aligned dowel handle ends rigidly fixed to said reel and respectively extending from the respective opposite sides thereof, said reel assembly when held by the hands of the operator by the dowel handle ends extending through yoked thumb and fore-fingers enable the reel to unwind freely in response to the gravity pull of the toy-like object down the inclined guide line between its supports but upon thumbs and fingers upon the dowel ends may be restrained in its downward movement and when the handle ends be fully grasped being operable to rewind the pulled out control line from the reel and return the toy-like object to the desired elevated position upon its guide line.

* * * * *